US007325255B2

(12) United States Patent
Cunliffe

(10) Patent No.: US 7,325,255 B2
(45) Date of Patent: Feb. 5, 2008

(54) HAT WITH RETRACTABLE ACCESSORY ATTACHMENTS

(76) Inventor: Steven E. Cunliffe, 8653 Avenida Costa Norte, San Diego, CA (US) 95154

( * ) Notice: Subject to any disclaimer, the term of this patent is extended or adjusted under 35 U.S.C. 154(b) by 121 days.

(21) Appl. No.: 11/415,682

(22) Filed: May 2, 2006

(65) Prior Publication Data

US 2007/0266477 A1 Nov. 22, 2007

(51) Int. Cl.
*A42B 1/24* (2006.01)

(52) U.S. Cl. ..... 2/209.13; 2/175.7

(58) Field of Classification Search ..... 2/209.13, 2/175.7, 10, 12; 224/918
See application file for complete search history.

(56) References Cited

U.S. PATENT DOCUMENTS 706,697 A * 8/1902 Sims ..... 242/379.2
938,281 A * 10/1909 Soneshien ..... 2/175.7
1,055,676 A * 3/1913 Shaw ..... 2/46
2,112,339 A * 3/1938 Kasparek ..... 224/249
3,908,875 A * 9/1975 Wilson et al. ..... 224/254
5,581,821 A * 12/1996 Nakano ..... 2/422
5,905,560 A * 5/1999 Daniel ..... 351/157
6,154,887 A * 12/2000 Yagi ..... 2/175.7
6,202,263 B1 * 3/2001 Harker ..... 24/300
6,446,265 B1 * 9/2002 Moreau et al. ..... 2/175.7
6,450,718 B1 * 9/2002 Spruill ..... 401/131
6,644,807 B1 * 11/2003 Hood ..... 351/155
6,877,168 B1 * 4/2005 Duffy et al. ..... 2/175.7
7,013,491 B2 * 3/2006 Ferrara ..... 2/209.13

* cited by examiner

*Primary Examiner*—Katherine Moran
(74) *Attorney, Agent, or Firm*—Eric Hanscom; Todd Langford

(57) ABSTRACT

The present invention involves a hat with the ability to store a small item. The hat is preferably a standard baseball cap, but can also be a visor. The hat contains a sleeve therein for holding an item such as a pen, bottle opener, or golf tee. One end of the sleeve contains a retractable band for attachment to an item. The other end of the sleeve contains an opening for access to an item. The retractable band retains the item within the sleeve when the item is not being used. A wearer can reach into the sleeve, pull the item out of the sleeve, use the item, and then place it into the sleeve wherein the retractable band holds it in place while the hat is worn. The retractable band can have an attachment device on one end for the removable attachment of an accessory.

14 Claims, 6 Drawing Sheets

HAT WITH RETRACTABLE ACCESSORY ATTACHMENTS

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF INVENTION

1. Field of the Invention

The invention generally relates to the field of clothing, namely hats. More particularly, the present invention relates to baseball caps with retractable accessory holders.

2. Description of the Related Art

Humans have been wearing all kinds of hats to cover their heads for centuries. More recently however, baseball style caps have become a very popular with men, women, young, and old alike. Baseball caps are worn for various reasons, including fashion and sun protection. Baseball caps are also worn during various activities, such as while working indoors/outdoors and while playing sporting events such as golf, tennis, and baseball. It is a common occurrence that while a person is wearing a baseball cap, they are engaged in an activity that requires the use of a small item such as a pen, pencil, bottle cap opener, golf tee, or miniature flashlight. If the person does not have such an item handy, they must locate the item, which can take a long time and be very frustrating.

Previous inventions have attempted to provide a solution to this problem. For example, baseball style caps have been designed having holes in the sides thereof to allow placement of an accessory within the holes. While these hats have succeeded in holding small accessories, the accessories are visible on the outside of the hat, which reduces the aesthetic appeal of the hat. Further, other hats have been designed with a pouch or pocket that is attached to the inside of the hat. While this also helps to contain a small accessory, a wearer must take off the hat to use the accessory located in the inner pouch. This can be inconvenient if a person intends to frequently use the accessory contained within the pouch. Additionally, having a pouch located on the inside of a hat with an item inside can be uncomfortable to wear for a prolonged period of time.

Therefore, there is a present need for a baseball style cap that can hold and conceal a small accessory within the hat in a ready-to-use position that is easily reachable, in a position that minimizes discomfort, does not detract from the style of the cap.

In this respect, before explaining at least one embodiment of the invention in detail it is to be understood that the invention is not limited in its application to the details of construction and to the arrangement of the components set forth in the following description or illustrated in the drawings. The invention is capable of other embodiments and of being practiced and carried out in various ways. In addition, it is to be understood that the phraseology and terminology employed herein are for the purpose of description and should not be regarded as limiting.

SUMMARY OF THE INVENTION

A primary advantage of this invention is to provide a hat with the capability to hold and retractably conceal a variety of small items such as bottle cap openers, markers, pencils, miniature flashlights, and golf tees.

It is a further advantage of this invention to provide a hat with the capability to hold and retractably conceal a small item without detracting from the outward appearance of the hat.

It is another advantage of this invention to provide a hat with the capability to hold and retractably conceal a small item that is comfortable to wear.

It is a still another advantage of this invention to provide a unique item concealing hat to the field of hats, namely baseball caps.

A final advantage of this invention is to provide an interchangeable removably attachable device upon which one or more retractable items can be removably attached.

These advantages and further advantages and features of the invention will be apparent to one skilled in the art from the disclosure of the present invention as set forth herein.

The present invention involves a hat with the ability to store a small item. The hat is preferably a standard wool or cotton baseball cap. The hat contains a sleeve therein for holding a small item such as a pen, bottle opener, or golf tee. One end of the sleeve contains a retractable band for attachment to an item. The other end of the sleeve contains an opening for access to an item. The retractable band retains the item within the sleeve when the item is not being used. A wearer can reach into the sleeve, pull the item out of the sleeve, use the item, and then place it into the sleeve wherein the retractable band holds it in place while the hat is worn. The sleeve can be sized to fit a pen, golf tee, bottle opener, miniature flashlight, chap stick, or other small item. The retractable band can have an attachment device on one end for the removable attachment of an item.

There has thus been outlined, rather broadly, the more important features of the invention in order that the detailed description thereof may be better understood, and in order that the present contribution to the art may be better appreciated.

There are additional features of the invention that will be described hereinafter and which will form the subject matter of the claims appended hereto.

BRIEF DESCRIPTION OF THE DRAWINGS

The accompanying drawings, which are incorporated in and form a part of this specification, illustrate embodiments of the invention and together with the description, serve to explain the principals of this invention.

DETAILED DESCRIPTION OF THE INVENTION.

Figure 1:
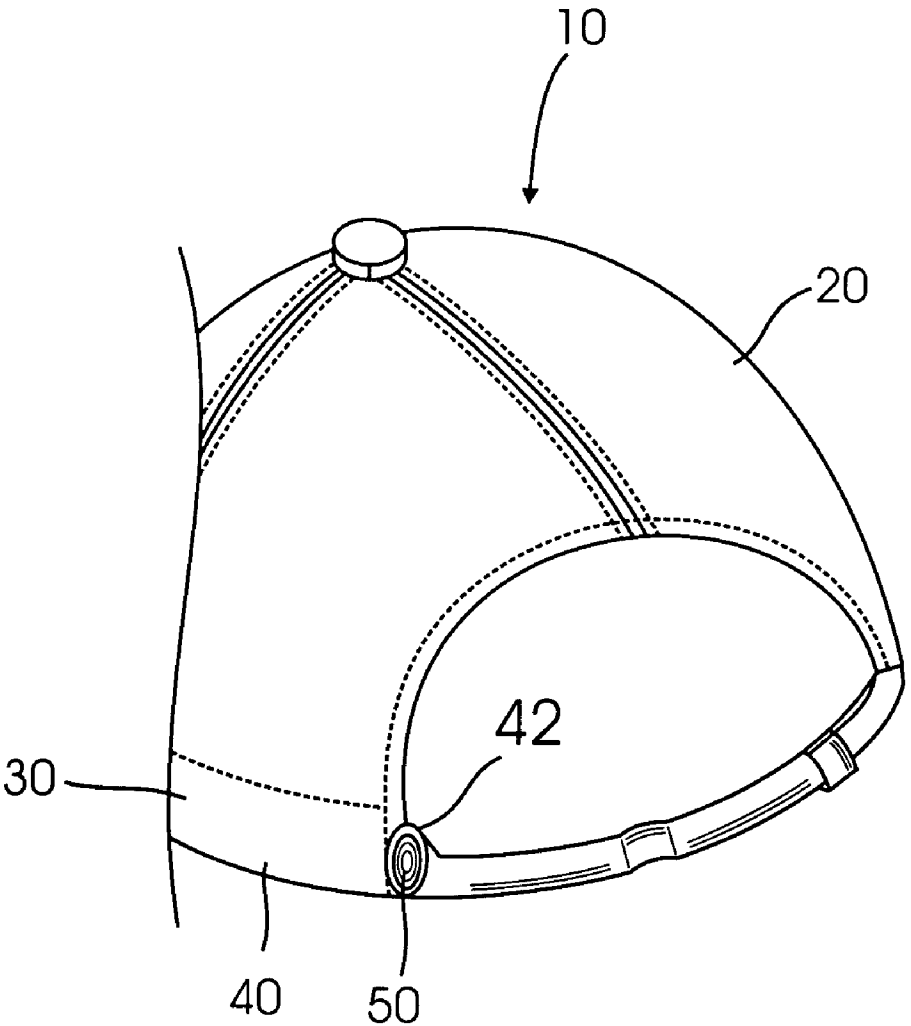
FIG. 1 shows a rear perspective view of the preferred embodiment of the hat with the retractable accessory attachment contained within the sleeve.

Referring now to the drawings, FIG. 1 shows a perspective view of the preferred embodiment of hat 10. Hat 10 includes a shell portion 20 and a rim portion 30. Rim portion 30 includes a sleeve 40, preferably located at an end thereof. Sleeve 40 has an opening 42, into which an item 50 is contained. Hat 10 is preferably a wool or cotton baseball cap. However, hat 10 can also be a visor or other hat with similar characteristics.

Figure 2:
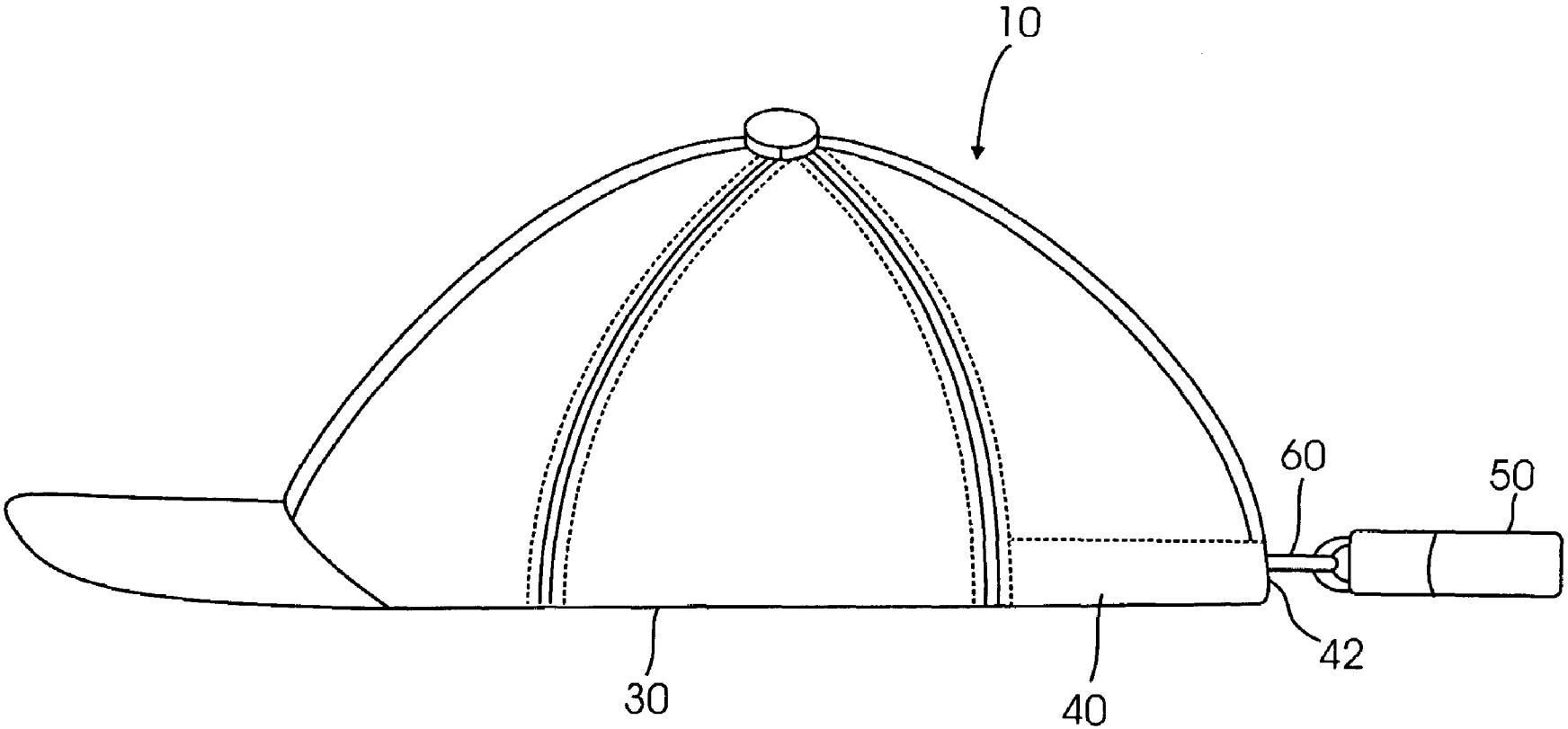
FIG. 2 shows a side view of the hat with the item removed from the sleeve, illustrating the retractable accessory attachment member.

FIG. 2 shows a side view of hat 10, including shell portion 20, rim portion 30, sleeve 40, and opening 42, with item 50 removed from sleeve 40 to expose retractable accessory attachment member 60.

Figure 3:
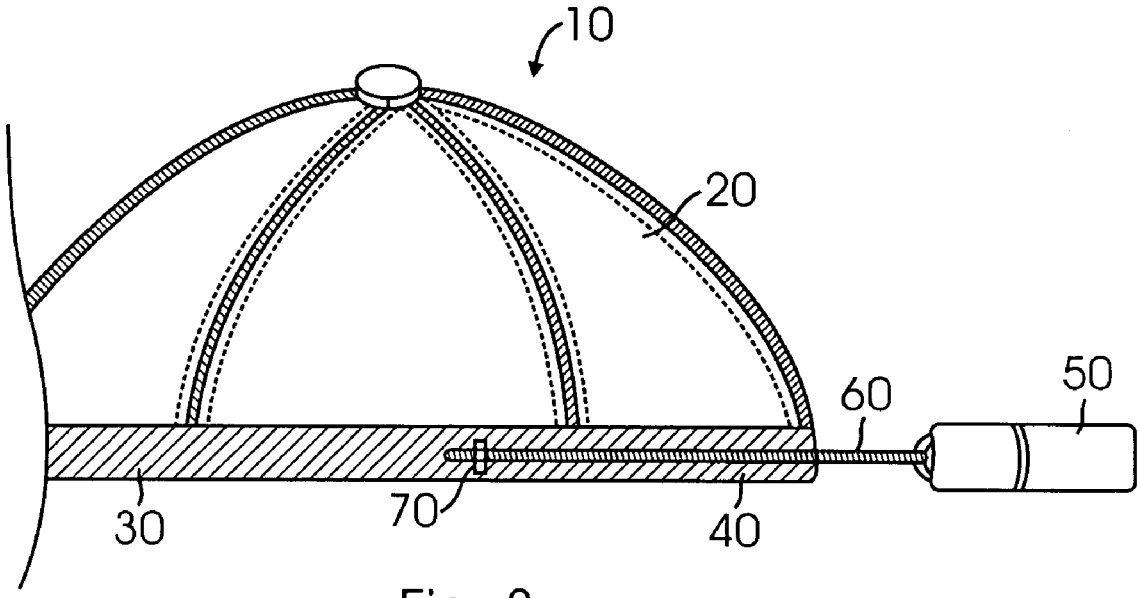
FIG. 3 shows a cross-sectional view of the sleeve portion of the hat, illustrating the attachment of the retractable band to the hat.

FIG. 3 shows a partial cross-sectional view of hat 10, illustrating the attachment of retractable accessory attachment member 60 to hat 10. Attachment member 60 is preferably attached to rim portion 30. Attachment member 60 can be attached to rim portion 30 within sleeve 40, or outside of sleeve 40. Attachment member 60 is preferably sewn into rim portion 30 by stitches 70.

Figure 4:
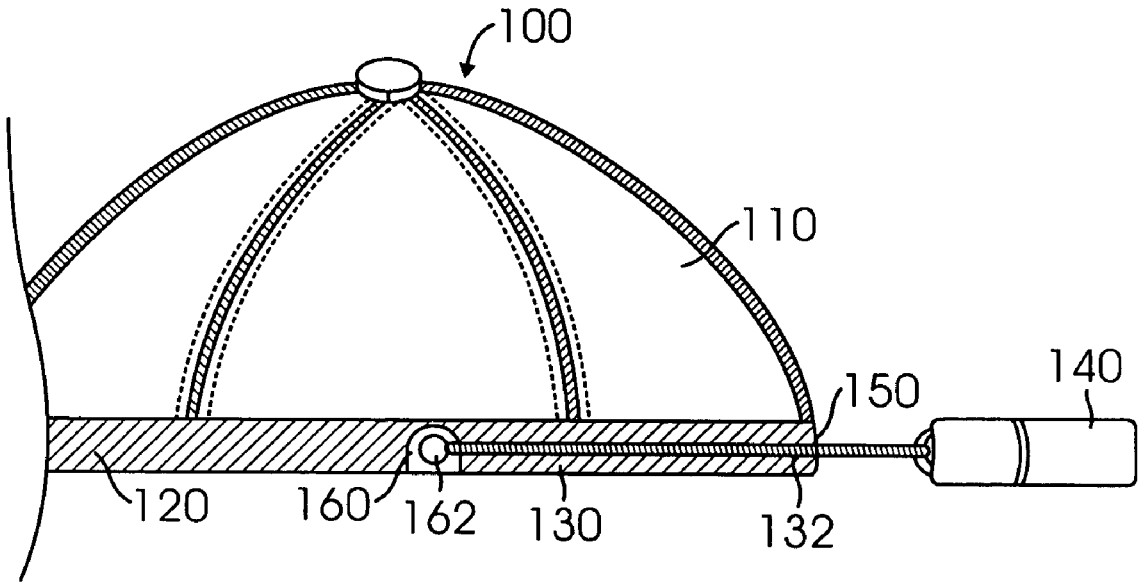
FIG. 4 shows an alternative embodiment of the hat containing a spool-type retractable band.

FIG. 4 shows a partial cross-sectional view of an alternate embodiment hat 100. Hat 100 includes a shell portion 110 and a rim portion 120. Rim portion 120 includes a sleeve 130, preferably located at an end thereof. Sleeve 130 has an opening 132, into which an item 140 is contained. Item 140 is attached to hat 100 by a retractable accessory attachment member 150. Attachment member 150 is preferably attached to rim portion 120. Attachment member 150 can be attached to rim portion 20 within sleeve 130, or outside of sleeve 130. Rim portion contains a retractable spool 160 with a spindle 162. Attachment member 150 is wound around spool 160, such that, when item 140 is pulled from sleeve 130, attachment member 150 unwinds from spool 160 and when item 140 is positioned within sleeve 130, attachment member 150 winds around spool 160.

Figure 5:
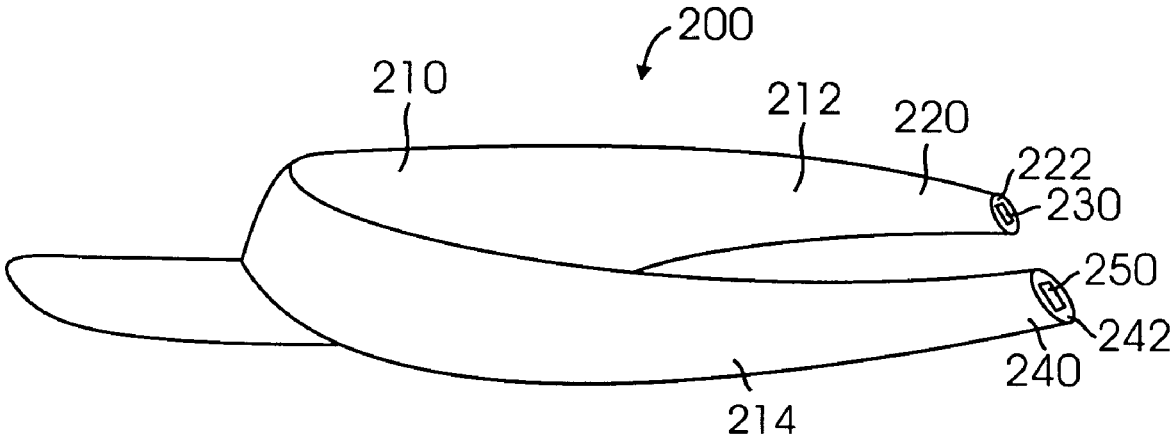
FIG. 5 shows an alternative embodiment of the hat having two retractable bands and sleeves for holding accessories.

FIG. 5 shows an alternative embodiment of the hat 200. Hat 200 has a base portion 210 having ends 212 and 214. A sleeve 220 is contained within end 212. Sleeve 220 has an opening 222 wherein an item 230 can be inserted. Another sleeve 240 is contained within end 214. Sleeve 240 has an opening 242 wherein an item 250 can be inserted. Item 230 and item 250 are preferably different in character, such as a pen and flashlight, but can be similar items.

Figure 6:
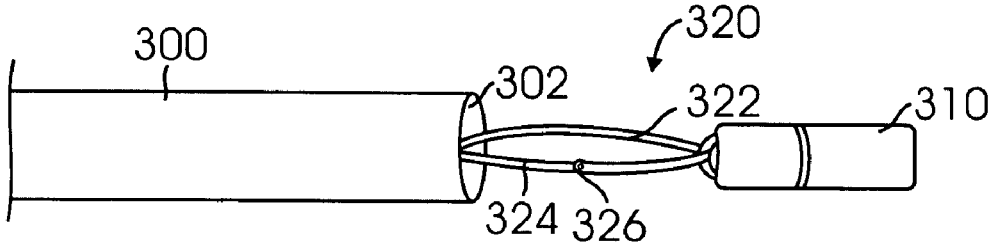
FIG. 6 shows a side view of a sleeve, separated from a hat, with an item removed, illustrating an alternate retractable accessory attachment member.

FIG. 6 shows a side view of a sleeve 300, separated from a hat, with an item 310 removed, illustrating an alternate retractable accessory attachment member 320. Attachment member 320 contains portions 322 and 324. Portions 322 and 324 are connected together by a connection means 326. Connection means 326 is preferably a snap, but can be other means for attachment such as a hook and loop, Velcro®, or other connection means as would be recognized by one with ordinary skill in the art. Item 310 can be retracted into cavity 302, which is the inside of sleeve 300.

Figure 7:
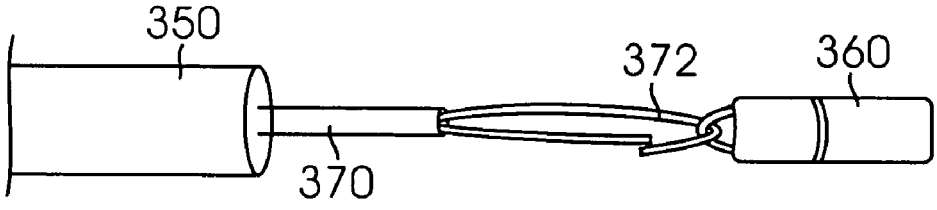
FIG. 7 shows a side view of a sleeve, separated from a hat, with an item removed, illustrating another alternate retractable accessory attachment member.

FIG. 7 shows a side view of a sleeve 350, separated from a hat, with an item 360 removed, illustrating an alternate retractable accessory attachment member 370. Attachment member 370 contains an accessory attachment device 372. In this embodiment, attachment device 372 is shown as a clip. However, accessory attachment device can be a hook, clasp, or any other attachment device as would be recognized by one with ordinary skill in the art.

Figure 8:
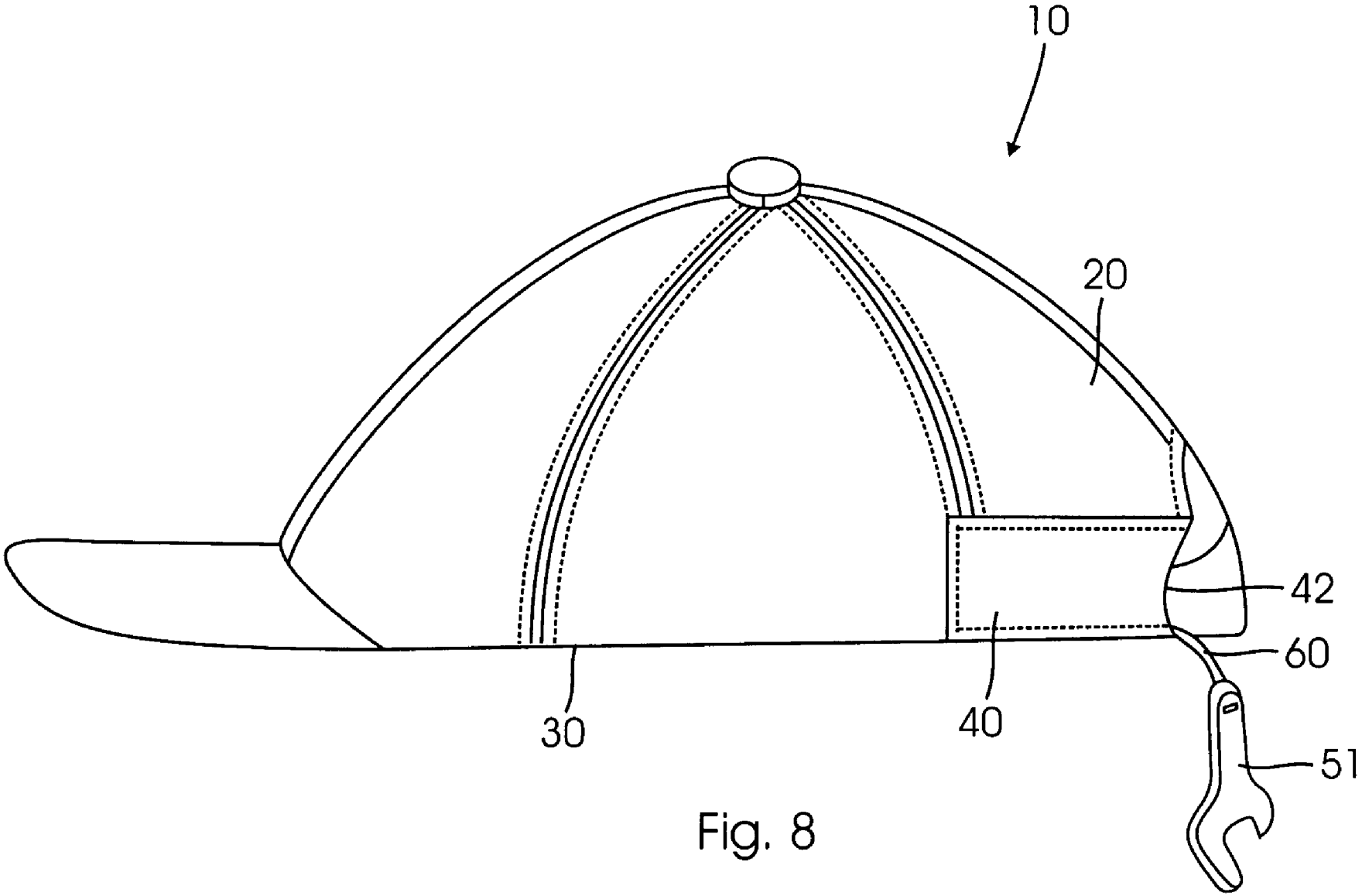
FIG. 8 shows a side view of the preferred embodiment of the hat having a bottle cap opener connected to the retractable accessory attachment member and removed from the sleeve.

FIG. 8 shows a side view of the preferred embodiment of the hat 10, including shell portion 20, rim portion 30, sleeve 40, and opening 42, having a bottle cap opener 51 connected to the retractable accessory attachment member 60 and removed from sleeve 40. Opener 51 can be one of various types of standard bottle cap openers.

Figure 9:
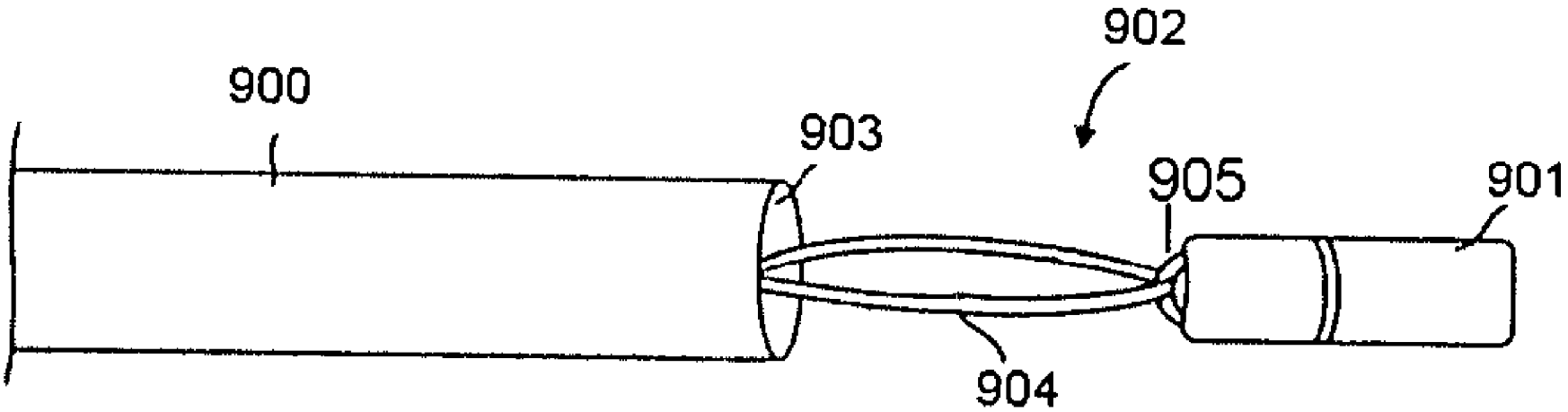
FIG. 9 shows an alternative embodiment of the hat having a loop of elastic material extending through a hole in an accessory, where both ends of the loop of elastic material are stitched or otherwise fixed inside of the sleeve.

FIG. 9 shows an iteration of the invention in which the means of connection (generally referred to by reference number 902) between sleeve 900 and accessory 901 is a piece of elastic material 904 that is looped through a lanyard or hole 905 in accessory 901 and both ends of the piece of elastic material are stitched or otherwise secured within the cavity 903 of sleeve 900, such that the piece of elastic material forms a loop which attaches the accessory to the hat.

With respect to the above description it is to be realized that the optimum dimensional relationships for the parts of the invention, including variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents fall within the scope of the present invention.

The above description, together with the accessories of the invention and the various features of novelty which characterize the invention, are pointed out with particularity in the claims annexed to and forming a part of this disclosure. For a better understanding of the invention, its operating advantages and the specific advantages attained by its uses, reference should be made to the accompanying drawings and descriptive matter in which there are illustrated preferred embodiments of the invention.

Further, the purpose of the foregoing abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting, as to the scope of the invention in any way.

I claim:

1. A hat comprising:

a) an outer shell having a front portion, a rear portion, two side portions, and a rim portion;

b) a strip of fabric attached on one end to the outer shell along the rim portion, the strip of fabric positioned within the outer shell;

c) at least one sleeve formed within the outer shell for the purpose of retaining an accessory, the at least one sleeve formed by attachment of a portion of the distal end of the strip of fabric to a side portion, the at least one sleeve having an opening on one end for removal of the accessory; and e) means for retractable attachment of the accessory within the at least one sleeve attached to the rim portion, wherein the means for retractable attachment of the accessory is an elastic band with means to connect an accessory to the elastic band, whereby to use the accessory, a user pulls the accessory from the opening, and after the user is finished with the accessory, the means for retractable attachment helps to retract the accessory back into the at least one sleeve and secure the accessory within the at least one sleeve when the accessory is not in use.

wherein both ends of the elastic band are stitched to the strip of fabric along the rim portion, the elastic band forming a loop within the sleeve, wherein the accessory can be connected to the loop.

2. The hat of claim 1, wherein the accessory is a wrench to tighten and loosen golfing spikes.

3. The hat of claim 1, wherein the accessory is a holder of golf tees.

4. The hat of claim 1, wherein the accessory is a bottle opener.

5. The hat of claim 1, additionally comprising a clip with a hole in it, where the clip is an accessory attachment device and the loop extends through the hole.

6. The hat of claim 1, wherein the accessory is a marking device.

7. The hat of claim 1, wherein the accessory is a screwdriver.

8. A hat comprising:

a) an outer shell having a front portion, a rear portion, two side portions, and a rim portion, the outer shell defining a dome-shaped interior region bounded by the rim portion;

b) a strip of fabric attached on one end to the outer shell along the rim portion, the strip of fabric positioned within the outer shell;

c) at least one sleeve formed within the outer shell for the purpose of retaining an accessory, the at least one sleeve formed by attachment of a portion of the distal end of the strip of fabric to a side portion, the at least one sleeve having an opening on one end for removal of the accessory; and d) an elastic band attached to the strip of fabric for the purpose of providing retractable attachment of the accessory whereby to use the accessory, a user nulls the accessory from the opening, and after the user is finished with the accessory, the elastic band helps to retract the accessory back into the at least one sleeve and secure the accessory within the at least one sleeve when the accessory is not in use, wherein the elastic band has an accessory attachment device positioned along the length of the elastic band the purpose of removable attachment of the accessory to the elastic band.

wherein both ends of the elastic band are stitched to the strip of fabric along the rim portion, the elastic band forming a loop within the sleeve, wherein the accessory attachment device can be connected to the loop.

9. The hat of claim 8, wherein the accessory attachment device is a clip.

10. The hat of claim 8, wherein the accessory is a bottle opener.

11. The hat of claim 8, wherein the accessory is a marking device.

12. The hat of claim 8, wherein the accessory is a wrench to tighten and loosen golf spikes.

13. The hat of claim 8, wherein the accessory is a holder of golf tees.

14. The hat of claim 8, wherein the accessory is a screwdriver.

* * * * *